US009366492B2

(12) United States Patent
Lee

(10) Patent No.: US 9,366,492 B2
(45) **Date of Patent: *Jun. 14, 2016**

(54) AMMUNITION MAGAZINE BASE PAD RETAINING PLATE

(71) Applicant: Apex Tactical Specialties, Inc., Los Osos, CA (US)

(72) Inventor: Randall M. Lee, Los Osos, CA (US)

(73) Assignee: Apex Tactical Specialties, Inc., Los Osos, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/489,450

(22) Filed: Sep. 17, 2014

(65) Prior Publication Data

US 2015/0000170 A1 Jan. 1, 2015

Related U.S. Application Data

(63) Continuation of application No. 13/587,808, filed on Aug. 16, 2012, now Pat. No. 8,925,231.

(51) Int. Cl.
*F41A 9/65* (2006.01)

(52) U.S. Cl.
CPC ..... *F41A 9/65* (2013.01); *Y10T 29/49716* (2015.01)

(58) Field of Classification Search
CPC ... F41A 9/61; F41A 9/656–9/671; F41A 9/83
USPC ..... 42/49.01, 49.02, 50
See application file for complete search history.

(56) References Cited

U.S. PATENT DOCUMENTS

| | | | | |
|---|---|---|---|---|
| 1,017,119 | A | 2/1912 | Toborg | |
| 3,191,332 | A | 6/1965 | Ardolino | |
| 3,372,506 | A | 3/1968 | Wilhelm | |
| 4,012,155 | A * | 3/1977 | Morris | 403/290 |
| 4,139,959 | A | 2/1979 | Howard | |
| 4,397,109 | A | 8/1983 | Pachmayr | |
| 4,495,720 | A | 1/1985 | Bross | |
| 4,768,704 | A | 9/1988 | Beckway | |
| 5,052,140 | A | 10/1991 | Smith | |
| 5,177,838 | A * | 1/1993 | Rotter | 24/625 |
| D344,780 | S | 3/1994 | Jenkins | |
| 5,291,679 | A | 3/1994 | Wollack | |
| 5,293,708 | A | 3/1994 | Strayer | |
| D359,098 | S | 6/1995 | Stevens | |
| 5,438,783 | A | 8/1995 | Sniezak | |
| D362,044 | S | 9/1995 | Sniezak | |
| 5,526,600 | A | 6/1996 | Chesnut | |

(Continued)

OTHER PUBLICATIONS

Non-final office action for U.S. Appl. No. 13/587,808 mailed May 21, 2014.

(Continued)

*Primary Examiner* — Joshua Freeman
(74) *Attorney, Agent, or Firm* — Fitch, Even, Tabin & Flannery LLP

(57) ABSTRACT

An ammunition magazine base pad retaining plate is provided with a protrusion including a shaft portion, a flange portion having a lager cross sectional diameter than the shaft portion, and a longitudinal slot to allow lateral compression. When attached to a magazine base pad in a magazine assembly, the configuration of the base pad retaining plate eliminates the possibility that the base pad retaining plate will disengage from the base pad resulting in catastrophic disassembly of the ammunition magazine.

18 Claims, 5 Drawing Sheets

(56) References Cited

U.S. PATENT DOCUMENTS

| | | | | |
|---|---|---|---|---|
| 5,566,487 | A | 10/1996 | Vaid | |
| 5,566,488 | A | 10/1996 | Yap | |
| 5,584,136 | A | 12/1996 | Boland | |
| 5,651,204 | A | 7/1997 | Hulsey | |
| 5,666,752 | A | 9/1997 | Grams | |
| D387,842 | S | 12/1997 | Kaminski | |
| D401,992 | S | 12/1998 | Pearce | |
| 5,906,065 | A | 5/1999 | Pearce | |
| 6,557,287 | B2 | 5/2003 | Wollmann | |
| D487,790 | S | 3/2004 | Freed | |
| D493,861 | S | 8/2004 | Rauch | |
| 6,928,764 | B2 | 8/2005 | Freed | |
| 7,093,386 | B1 * | 8/2006 | Vieweg | 42/7 |
| 7,117,622 | B2 | 10/2006 | Freed | |
| 7,200,964 | B2 | 4/2007 | Gates | |
| D574,053 | S | 7/2008 | McGarry | |
| D579,072 | S | 10/2008 | McGarry | |
| D583,896 | S | 12/2008 | McGarry | |
| D584,374 | S | 1/2009 | McGarry | |
| 7,509,767 | B2 | 3/2009 | Bolen | |
| D627,028 | S | 11/2010 | Coulombier | |
| 7,908,780 | B2 * | 3/2011 | Fitzpatrick et al. | 42/50 |
| D642,234 | S | 7/2011 | Marfione | |
| D650,880 | S | 12/2011 | McGarry | |
| 2013/0333261 | A1 | 12/2013 | Clifton | |

OTHER PUBLICATIONS

Lee; U.S. Appl. No. 13/587,808, filed Aug. 16, 2012.

Notice of Allowance for U.S. Appl. No. 13/587,808 mailed Sep. 2, 2014.

Notice of Allowability for U.S. Appl. No. 13/587,808 mailed Oct. 23, 2014.

* cited by examiner

AMMUNITION MAGAZINE BASE PAD RETAINING PLATE

CROSS-REFERENCE TO RELATED APPLICATIONS

This application is a continuation of U.S. patent application Ser. No. 13/587,808, filed Aug. 16, 2012, for AMMUNITION MAGAZINE BASE PAD RETAINING PLATE which is incorporated in its entirety herein by reference.

BACKGROUND OF THE INVENTION

1. Field of the Invention

The present invention relates generally to firearms, and more specifically to ammunition magazines for firearms.

2. Discussion of the Related Art

Many firearms utilize ammunition magazines to hold ammunition to be loaded into the firing chamber of the firearm and eventually fired. Specifically, handguns, and particularly semi-automatic handguns, often house an ammunition magazine in a cavity in the handle or grip portion. With such a configuration, the magazine is generally inserted upward into the cavity via an opening on the bottom surface of the firearm handle.

Often, ammunition magazines will include a magazine base pad attached to the lower portion of the magazine housing. As is understood in the art, the magazine base pad provides a surface external to the magazine cavity of the firearm that allows a user to interface with the magazine. Amongst other benefits, this allows a user to quickly orient the magazine for proper insertion during a reload as well as provides a bottom surface which allows a user to forcefully insert the magazine into its proper position within the magazine cavity.

Currently, a magazine base pad connects to the magazine housing by utilizing a base pad retaining plate to hold the magazine base pad in place. The base pad retaining plate typically comprises a cylindrical or square shaped protrusion on its lower surface which interacts with a corresponding through-hole in the magazine base pad. An ammunition magazine spring existing inside the magazine housing exerts downward forces on the base pad retaining plate to maintain the position of the protrusion inside the through-hole. The physical interference between the protrusion and the walls of the through-hole in turn keep the magazine base pad from sliding off the magazine housing.

With these known configurations, a sharp blow to the magazine (either from forceful insertion into the magazine cavity or dropping the magazine) can dislodge the protrusion from the through-hole allowing the magazine base pad to slide off the magazine housing resulting in catastrophic disassembly of the magazine. This condition is most probable when the magazine is fully or partially empty, which corresponds to less compression of the magazine spring and lower forces exerted on the base pad retaining plate. Thus, a more stable configuration that is resistant to impact forces is desired to eliminate catastrophic disassembly of the magazine.

Additionally, known base pads often closely match the dimensions and contours of the corresponding firearm's handle or grip. This makes it difficult to grasp or remove a magazine that is stuck within the magazine cavity of the firearm. Further, such a configuration results in an elongated front toe portion of the magazine base pad. This increases the likelihood that the magazine can catch on surfaces (such as other magazines or fingers) when extracting another magazine stored on a user's body in close proximity (i.e., in a pouch or magazine carrier). Moreover, the longer toe can inhibit proper palm indexing of the magazine for users with smaller hands. Thus, a magazine base pad that diverges from the contours of the firearm handle or grip is desired.

SUMMARY OF THE INVENTION

Several embodiments of the invention advantageously address the needs above as well as other needs. In one embodiment, the invention can be characterized as a base pad retaining plate configured to engage a magazine base pad and a magazine spring and comprising at least one protrusion for engagement with at least one through-hole on the magazine base pad. The protrusion may comprise a shaft portion, a flange portion having a cross sectional diameter larger than a cross sectional diameter of the shaft portion, and a longitudinal slot along the longitudinal axis of the flange portion and at least a portion of the shaft portion.

By another embodiment, a kit comprises the above described base pad retaining plate and a magazine base pad. By yet another embodiment, a method of modifying an ammunition magazine comprises installing a magazine base pad and the above described base pad retaining plate on the ammunition magazine housing.

In other embodiments, a magazine base pad comprises a through-hole and scalloped recesses on a front edge and on each lateral side of the magazine base pad. In further embodiments, the magazine base pad may comprise a front edge existing at a distance no more than about 0.440 inches from a front edge of the ammunition magazine housing; tapering lateral sides; dimples on the lower surface; and/or a counter sink surrounding the through-hole.

BRIEF DESCRIPTION OF THE DRAWINGS

The above and other aspects, features and advantages of several embodiments of the present invention will be more apparent from the following more particular description thereof, presented in conjunction with the following drawings.

Figure 1:
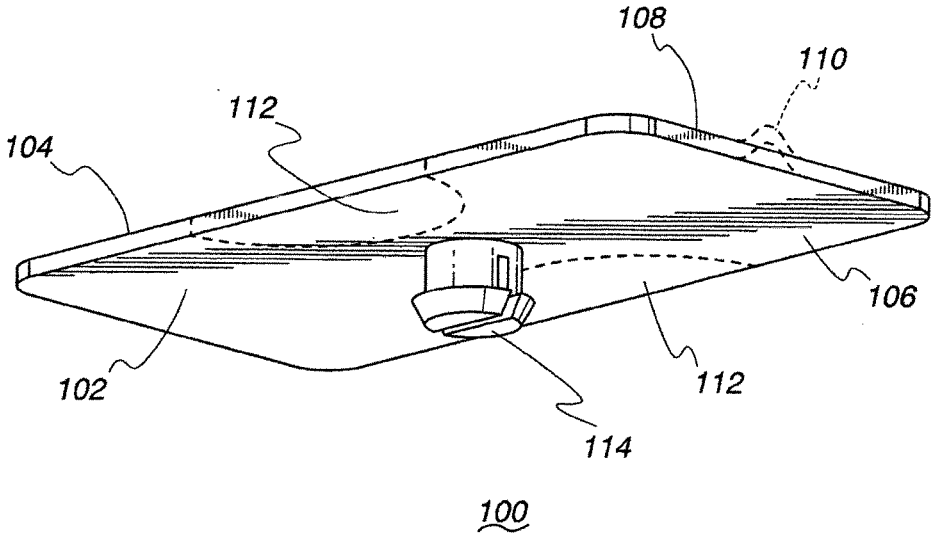
FIG. 1 is a diagram of a magazine base pad retaining plate in accordance with various embodiments.

Corresponding reference characters indicate corresponding components throughout the several views of the drawings. Skilled artisans will appreciate that elements in the figures are illustrated for simplicity and clarity and have not necessarily been drawn to scale. For example, the dimensions of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention.

DETAILED DESCRIPTION

The following description is not to be taken in a limiting sense, but is made merely for the purpose of describing the general principles of exemplary embodiments. The scope of the invention should be determined with reference to the claims.

Reference throughout this specification to "one embodiment," "an embodiment," or similar language means that a particular feature, structure, or characteristic described in connection with the embodiment is included in at least one embodiment of the present invention. Thus, appearances of the phrases "in one embodiment," "in an embodiment," and similar language throughout this specification may, but do not necessarily, all refer to the same embodiment.

Furthermore, the described features, structures, or characteristics of the invention may be combined in any suitable manner in one or more embodiments. In the following description, numerous specific details are provided to provide a thorough understanding of embodiments of the invention. One skilled in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Referring first to FIG. 1, a base pad retaining plate 100 for an ammunition magazine 600 is shown. The base pad retaining plate 100 comprises a planar plate portion 102 that can be partially or entirely flat. Though not shown, the planar plate portion 102 may comprise various contours or textures formed into the top surface 104 or bottom surface 106. By one embodiment, a front edge 108 of the base pad retaining plate 100 may have one or more structures, detents, or contours 110 formed therein to aid in the retaining functionality of the base pad retaining plate 100 by providing interference with an interior wall of front edge 606 of an ammunition magazine housing 602 (see FIG. 6). Similar structures, detents, or contours 110 may exist on other edges of the base pad retaining plate 100. By another embodiment, a magazine spring clip (not shown) is incorporated into a rear portion of the top surface 104 which serves to retain and engage a magazine spring 702 and may also serve to provide retaining functionality by interfering with a rear interior wall of an ammunition magazine housing 602. Moreover, by some embodiments, sides 112 of the planar plate portion 102 may be contoured to comprise, by at least one example, an hourglass shape, though other shapes are possible.

The base pad retaining plate 100 further comprises at least one protrusion 114 on the bottom surface 106. By one embodiment, the protrusion 114 extends from the approximate center of the planar plate portion 102. By at least one other embodiment, the protrusion 114 can be located on a rear section of the bottom surface 106 of the planar plate portion 102. Various other placements and quantities may exist and are contemplated by this application.

The protrusion 114 may be an independent piece that is affixed or otherwise connected to the planar plate portion 102. By another approach, the protrusion 114 is fully integrated with the planar plate portion 102, possibly as the result of injection mold processes or other known processes. By at least one embodiment, the protrusion 114 is formed of plastic or fiber-reinforced plastic (such as fiberglass, carbon fiber, or aramid fiber reinforced plastic) or other rigid yet flexible materials. In the instance that the protrusion 114 and the planar plate portion 102 are integral, they may be composed of the same material and from the same molding process.

Figure 2:
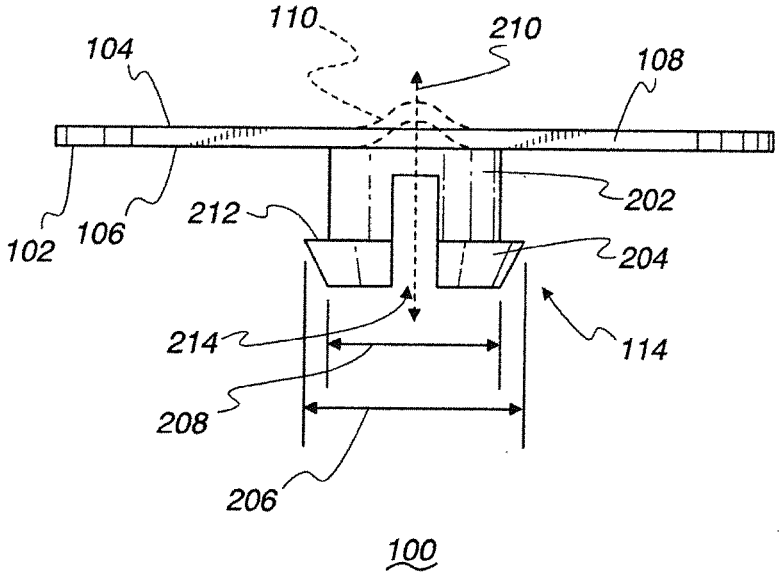
FIG. 2 is an additional view of the magazine base pad retaining plate of FIG. 1 in accordance with various embodiments.

Referring now to FIG. 2, a detailed view of the base pad retaining plate 100 is shown from the front. The protrusion 114 comprises a shaft portion 202 and a flange portion 204 having a cross sectional diameter 206 that is larger than the cross sectional diameter 208 of the shaft portion 202, giving the protrusion 114 a general mushroom shape or profile. The shaft portion 202 is connected to the planar plate portion 102 of the base pad retaining plate 100 at one end and to the flange portion 204 at the other. The shaft portion 202 and the flange portion 204 share a common longitudinal axis 210, which extends substantially perpendicular to the general plane of the planar plate portion 102, though other orientations are possible.

Although depicted in FIG. 1 as having circular cross sections, the shaft and flange portions 202, 204 may comprise other cross section shapes such as a an oval, square, rectangle, triangle, or other shapes. Further, the cross sectional shapes of the shaft portion 202 and flange portion 204 may be distinct (such as a circular shaft portion 202 cross section combined with a square flange portion 204 cross section). Additionally, although the shaft portion 202 is depicted as a circular cylinder with generally parallel side-walls, other configurations are possible such as sides that uniformly or disparately taper up or down. Moreover, although the flange portion 204 is depicted as a conical frustum, other shapes are possible using side walls with a straight profile (resulting in, for example, a pyramidal frustum or wedge frustum) or side walls with a convex or concave curved profile (resulting in, for example, a spherical, ellipsoidal, or parabolical frustum). Further still, the side walls of the flange portion 204 may be generally parallel to one another along a portion of, or even a majority of, the longitudinal length of the side walls. However, as the flange portion 204 will generally be inserted through a through-hole 302 (described below, see FIG. 3), it may be beneficial that the end of the flange portion 204 opposite the shaft portion 202 have a smaller diameter than the end of the flange portion 204 attached to the shaft portion 202 such that at least a portion of the side walls of the flange portion 204 taper away from the shaft portion 202 allowing the flange to wedge through the through-hole 302. In one example, however, if the through-hole 302 is to have a tapering countersink on the side which the protrusion 114 encounters first (i.e., the recessed upper surface 304, see FIG. 3) as it is pushed through, the protrusion 114 may have entirely parallel side walls as that countersink will provide the necessary wedging means.

By one embodiment, the flange portion 204 comprises a surface 212 on the end attached to the shaft portion 202. This surface 212 may be substantially flat and perpendicular to the longitudinal axis 210 of the shaft and flange portions 202, 204, though other configurations are possible.

The protrusion 114 comprises a longitudinal slot 214 along the longitudinal axis 210 of the flange portion 204 and shaft portion 202. By one embodiment, the longitudinal slot 214 exists along the entire longitudinal axis 210 of the flange portion 204 and at least a portion of the longitudinal axis 210 of the shaft portion 202. The longitudinal slot 214 is illustrated as running from the front to the back of the base pad retaining plate 100, however any orientation is possible. So configured, the flange portion 204 of the protrusion 114 is capable of being laterally compressed due to lateral forces such that the cross sectional diameter 206 of the of the flange portion 204 decreases.

Figure 3:
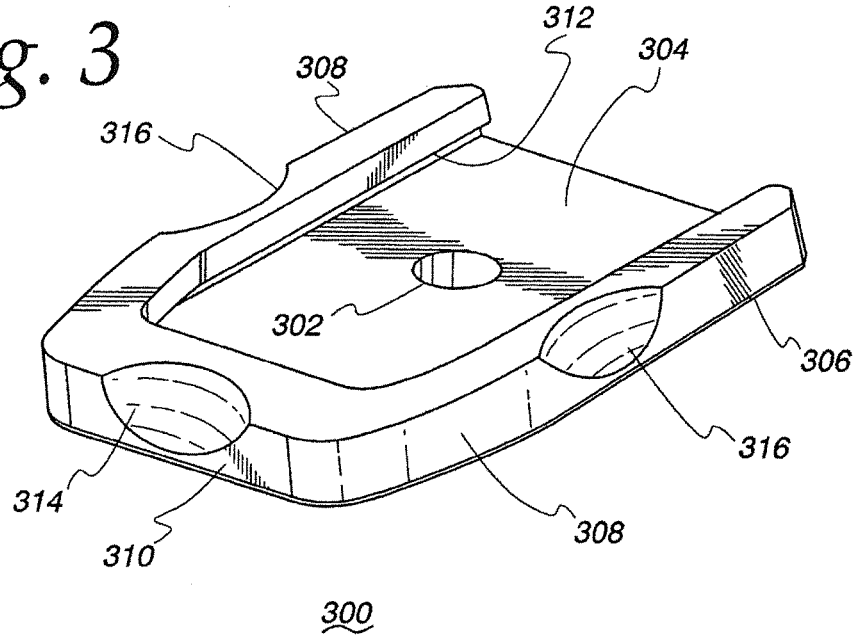
FIG. 3 is a diagram of a magazine base pad in accordance with various embodiments.
Figure 4:
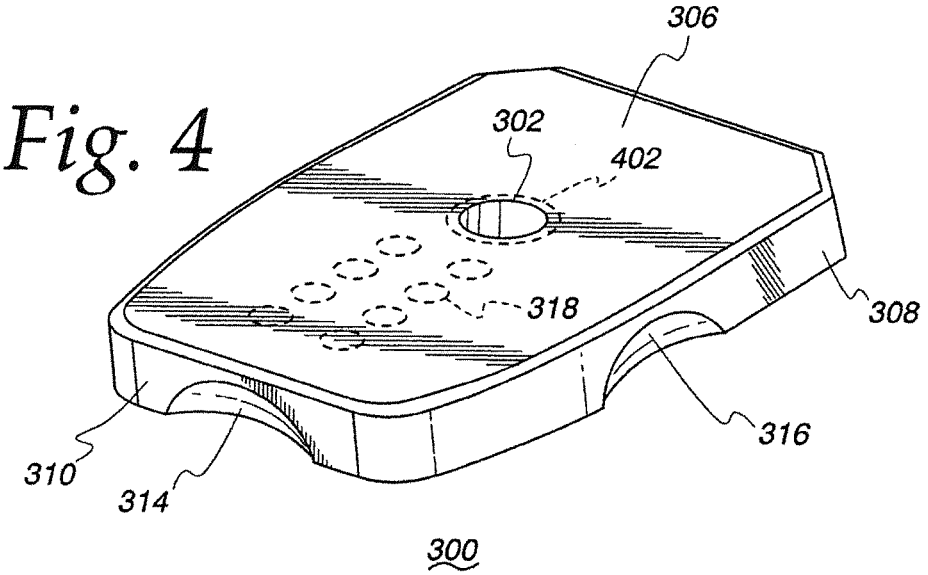
FIG. 4 is an additional view of the magazine base pad of FIG. 3 in accordance with various embodiments.
Figure 5:
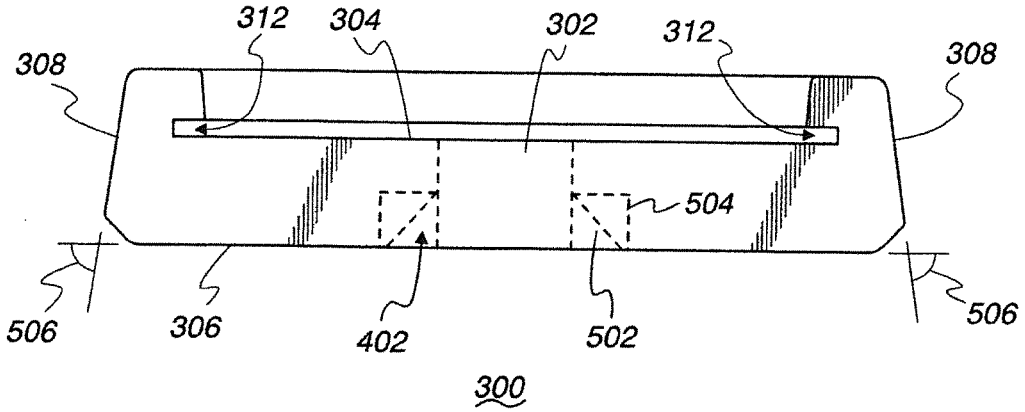
FIG. 5 is yet another view of the magazine base pad of FIG. 3 in accordance with various embodiments.
Figure 6:
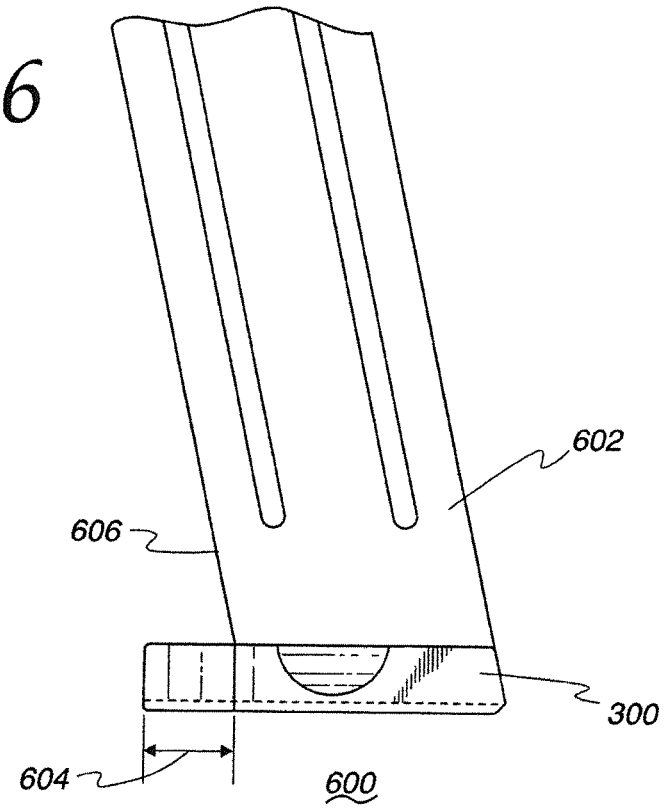
FIG. 6 is an illustration of a magazine including the magazine base pad of FIG. 3 installed on a magazine housing in accordance with various embodiments.

With reference now to FIGS. 3, 4, and 5, an ammunition magazine base pad 300 is illustrated. FIGS. 3 and 4 depict perspective views from above and below the magazine base pad 300, respectively, while FIG. 5 is a cross-section view of the magazine base pad 300. The magazine base pad 300 comprises at least one through-hole 302 extending from a recessed upper surface 304 to a bottom surface 306. By one embodiment, a countersink 402 is formed in the area directly surrounding the through-hole 302 on the bottom surface 306. As is most evident in FIG. 5, the countersink 402 may be conical 502 or cylindrical 504 in shape. The lateral sides 308 and front edge 310 of the magazine base pad 300 extend generally upward from the bottom surface 306 to above the recessed upper surface 304. The lateral sides 308 each have internal grooves 312 formed therein extending from the back of the magazine base pad 300 toward the front and configured to receive lips 704 formed in the bottom sides of the ammunition magazine housing 602 (see FIGS. 7 and 8). So configured, the magazine base pad 300 can slide from front to back onto the lower portion of the magazine housing 602 and therefore be affixed to the magazine housing 602 (as shown in FIG. 6).

In one embodiment, the magazine base pad 300 comprises a scalloped recess 314 on the front edge 310 and scalloped recesses 316 on each lateral side 308. The scalloped recesses 314, 316 provide a surface to aid a user in stripping the ammunition magazine 600 from a firearm if, for example, it were to become stuck inside the magazine cavity of the firearm, or to aid a user in the retention of the ammunition magazine 600 in their hand as they remove it and insert a new fully loaded ammunition magazine 600.

In another embodiment, the lateral sides 308 can taper upwards. Such a taper may result in, for example, an angle 506 between the bottom surface 306 of the magazine base pad 300 and at least a majority of the surface of each lateral side 308 measuring between 75 degrees and 85 degrees. By one example, the angle 506 is 80 degrees. The tapered lateral sides 308 can aid a user in gripping the ammunition magazine 600 during removal from the firearm as the contours of the magazine base pad 300 are divergent from those of the handle of the firearm and provide a slightly flared bottom surface 306 to improve downward grip.

By one approach, the bottom surface 306 of the magazine base pad 300 can comprise a plurality of dimples 318. The dimples 318 can be arranged in a simple manner, such as two straight lines, and may be of any suitable quantity (such as 8 as shown), shape, or depth. So configured, the dimples 318 allow a user to mark individual ammunition magazines 600 for identification purposes.

FIG. 6 depicts an ammunition magazine 600 including the magazine base pad 300 installed on the magazine housing 602. Illustrated is a distance 604 from the front edge 310 of the magazine base pad 300 to a front edge 606 of the magazine housing 602 when the magazine base pad 300 is installed on the magazine housing 602. By one approach, this distance 604 does not exceed about 0.440 inches. This serves to reduce a snag hazard. For example, if a user stores ammunition magazines 600 in a magazine pouch or carrier, the user may accidentally snag a second magazine when reaching for a first magazine during a quick reload. The snagged magazine may then fall off of the body such that it is unavailable to the user during subsequent reloads or is lost. By keeping the distance 604 shorter, this snag hazard is reduced.

Further, by reducing the distance 604, an improved palm index in the hand is achieved during reloading. This palm index is a position achieve by placing the front edge 310 of the magazine base pad 300 in the center of the palm of the support hand and extending the index finger up the front edge 606 of the magazine housing 602 during reloading. This aids the user to quickly insert the magazine 600 into the magazine cavity and to exert force on the bottom surface 306 of the magazine base pad 300 with the lower part of the palm to place the magazine 600 in the proper operational position within the firearm. For users with smaller or medium sized hands, an overly large distance 604 serves to push the magazine housing 602 away from the palm and make a proper index more difficult. Therefore, reducing the distance 604 promotes proper palm indexing for such users.

Figure 7:
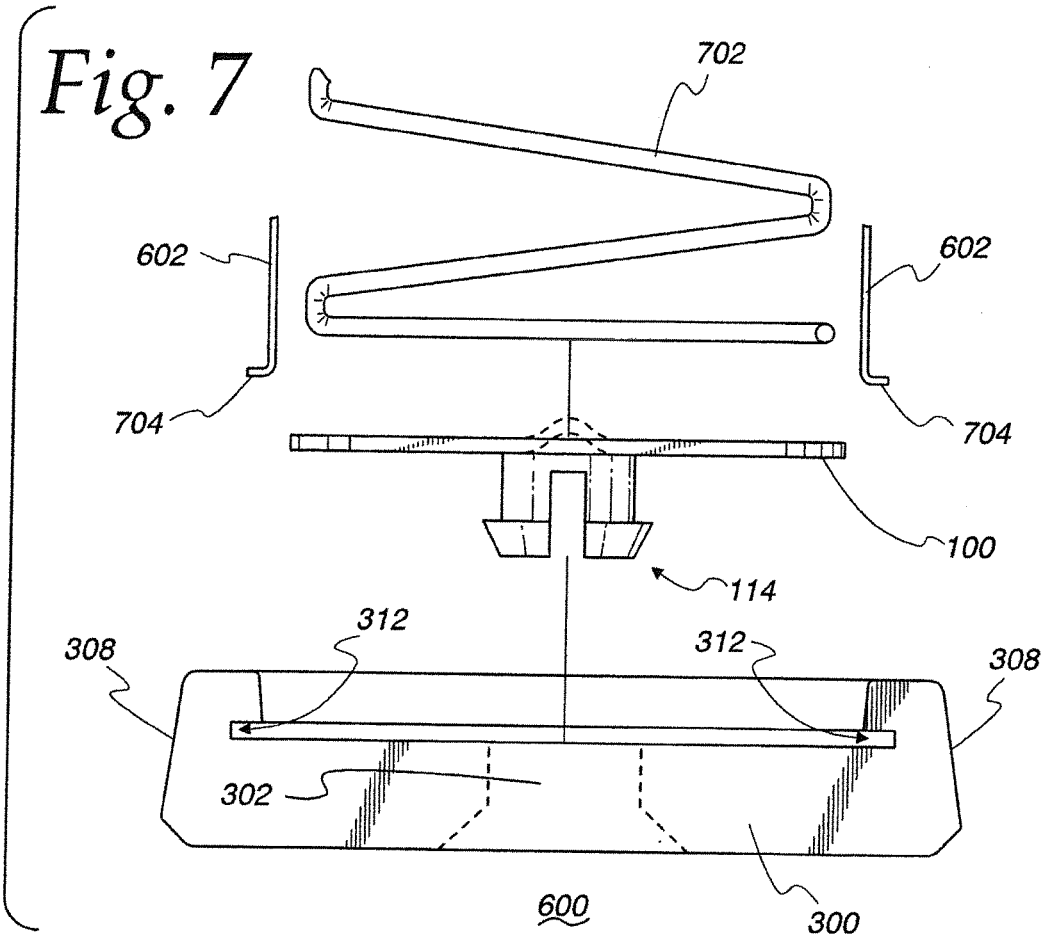
FIG. 7 is a cross section of an exploded view of the magazine FIG. 6 in accordance with at least one embodiment.
Figure 8:
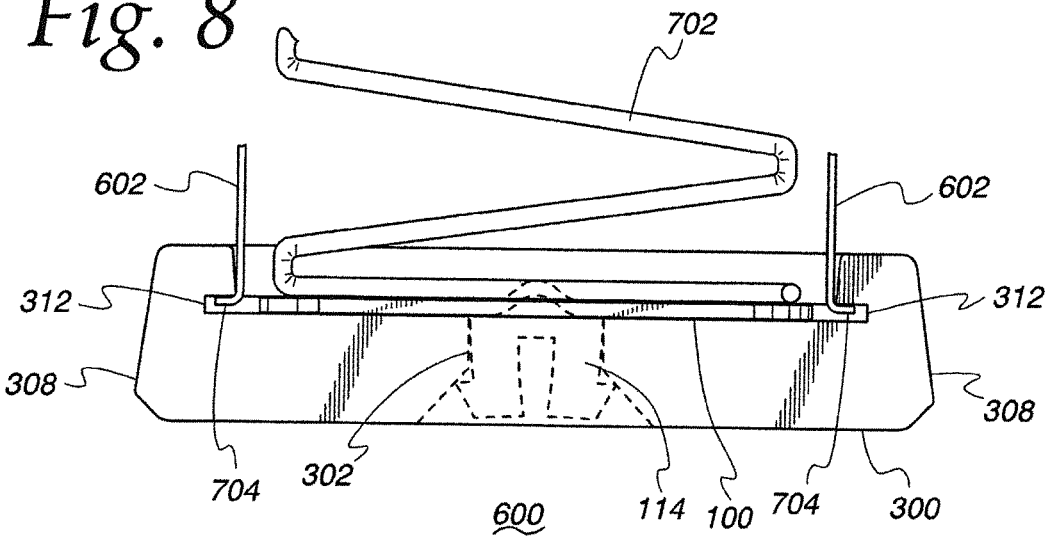
FIG. 8 is a cross section of the magazine of FIG. 7 assembled in accordance with various embodiments.

Turning now to FIGS. 7 and 8, FIG. 7 shows a cross section from front to back of and exploded view of the magazine 600 while FIG. 8 shows a cross section of the assembled magazine 600. As assembled, the magazine 600 comprises the magazine base pad 300, the base pad retaining plate 100, the magazine housing 602, and a magazine spring 702. The base pad retaining plate 100 is configured to fit inside the magazine housing 602. As previously described, each side of the magazine housing 602 has an integrated lip 704. The magazine base pad 300 slides onto the magazine housing 602 by lining up the internal grooves 312 incorporated into the internal surfaces of the lateral sides 308 of the magazine base pad 300 to slide along the lips 704 until a rear surface of the front edge 310 encounters the front edge 606 of the magazine housing 602 to thereby inhibit further rearward sliding. At or near that position, the through-hole 302 of the magazine base pad 300 will vertically line up with the protrusion 114 of the base pad retaining plate 100 situated internal to the magazine housing 602. The protrusion 114 can then engage the through-hole 302 by being inserted into and pressed through the through-hole 302, as shown in FIG. 8.

Figure 9:
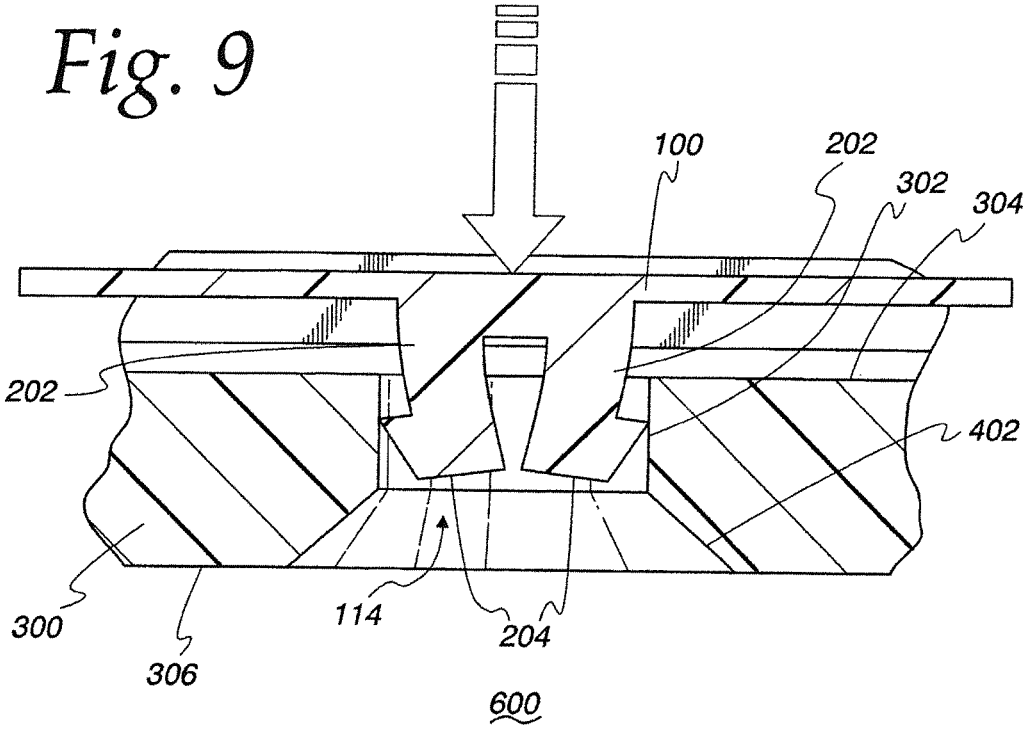
FIG. 9 is a detailed cross section of the magazine of FIG. 8 in accordance with various embodiments.
Figure 10:
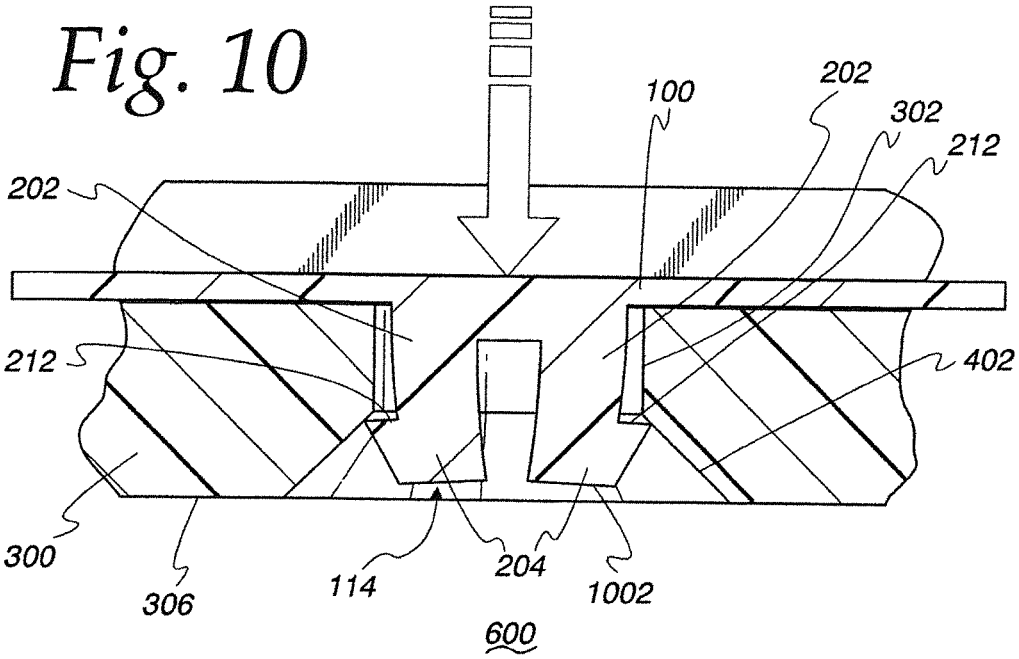
FIG. 10 is another detailed cross section of the magazine of FIG. 8 in accordance with various embodiments.

Referring next to FIGS. 9 and 10, detailed cross sectional views of the protrusion 114 passing through the through-hole 302 in accordance with one embodiment are illustrated. FIG. 9 shows the protrusion 114 partially pushed through the through-hole 302. Due to the shape of the flange portion 204 of the protrusion 114 (or, optionally, a shape of a countersink (not shown) on the recessed upper surface 304 of the magazine base pad 300), the protrusion 114 will laterally compress so that its overall diameter is less than that of the through-hole 302 as it is wedged into the through-hole 302. The wedging action is required as the flange portion 204 has a cross sectional diameter 208 that is larger than the diameter of the through-hole 302. As the protrusion 114 passes through the through-hole 302, the protrusion 114 will maintain this laterally compress state until the flange portion 204 has substantially passed through the through-hole 302, as is shown in FIG. 10. Due to elastic principles of the material used, once the flange portion 204 has passed through the through-hole 302, the protrusion 114 will re-expand to a substantially less compressed state. The substantially less compressed state may include the protrusion 114 expanding back to its completely uncompressed state, or as depicted in FIG. 10, a slightly compressed state caused by interference between the flange portion 204 and a countersink 402 or between the shaft portion 202 and the interior walls of the through-hole 302.

Once expanded, a surface 212 of the flange portion 204 attached to the shaft portion 202 will interfere with a surface around the through-hole 302, be it the bottom surface 306 of the magazine base pad 300 or a countersink 402 formed therein (as depicted in FIGS. 9 and 10) to prevent the protrusion 114 from exiting the through-hole 302 in the opposite direction. At this point, the shaft portion 202, having a cross sectional diameter 208 that is less than the diameter of the through-hole 302, will reside substantially inside the through-hole 302. So configured, the protrusion 114 will retain the magazine base pad 300 to the base pad retaining plate 100 through interference between the flange portion 204 and the area surrounding through-hole 302 and between the shaft portion 202 and the interior walls of the through-hole 302.

Once attached, the base pad retaining plate 100 will inhibit forward movement of the magazine base pad 300 in relation to the magazine housing 602 as a front edge 108 of the base pad retaining plate 100, possibly via one or more optional structures, detents, or contours 110 on the front edge 108, will interfere with the interior surface of the front edge 606 of the magazine housing 602. This interference prevents the base pad retaining plate 100 from moving forward, which in turn prevents the magazine base pad 300 from moving forward and off of the magazine housing 602 through interference between the shaft portion 202 or flange portion 204 of the protrusion 114 and the interior walls or surrounding area of the through-hole 302.

Further, because the flange portion 204 inhibits the protrusion 114 from exiting the through-hole 302, the base pad retaining plate 100 will remain attached to the magazine base pad 300 even when sharp forces are applied to the bottom surface 306 of the magazine base pad 300 (such as when the magazine 600 is forcefully inserted into the firearm or if the magazine 600 is dropped on the ground). Previous designs did not include a flanged protrusion 114 and relied solely on the force of the magazine spring 702 to remain seated within the through-hole 302. As the magazine spring 702 weakened or decompressed as the magazine 600 emptied, the magazine spring 702 applies less force to the top of the base pad retaining plate 100 such that sharp forces applied to the bottom surface 306 of the magazine base pad 300 could cause the base pad retaining plate 100 to hop up off of the magazine base pad 300. When this occurs, the non-flanged protrusion exits the through-hole 302 thereby allowing the magazine base pad 300 to slide forward and off of the magazine housing 602, resulting in catastrophic disassembly of the magazine 600. The use of a protrusion 114 including the flange portion 204 eliminates this problem.

Moreover, the designs disclosed herein allow for removal of the magazine base pad 300 from the magazine housing 602 without the use of special tools. The user can quickly use their fingers or some other sharp surface (i.e., the edge of another magazine 600 or a bullet) to compress the flange portion 204 to push the protrusion 114 up and out of the through-hole 302 allowing for quick disassembly of the magazine 600 (even in the field) when such disassembly is intended. If a countersink 402 is utilized, the bottom surface 1002 of the flange portion 204 can be situated at or above the plane of the bottom surface 306 of the magazine base pad 300 such that it will not stick out beyond that plane. This reduces the chance that the flange portion 204 will accidentally become compressed to allow the protrusion 114 to unintentionally exit the through-hole 302.

By another embodiment, a kit is provided comprising the magazine base pad 300 and the base pad retaining plate 100 as described herein. By yet another embodiment, a method of modifying an ammunition magazine 600 for a firearm includes installing the magazine base pad 300 and the base pad retaining plate 100 as described herein on the magazine housing 602.

It is understood that this disclosure contemplates an ammunition magazine 600 manufactured or modified with any number of the above described components (including, but not limited to the magazine base pad 300, the base pad retaining plate 100, the magazine housing 602, and the magazine spring). Additionally, this disclosure contemplates a method of modifying an ammunition magazine 600, being modified by a factory, a dealer, or an individual, to replace any number of factory standard components with any number of the above described components. Additionally still, this disclosure contemplates assembly, distribution, sales, or otherwise providing of a parts kit comprising any number of the above described components. Additionally even still, this disclosure contemplates installation of any number of the above described components onto an ammunition magazine 600.

Though other applications may exist, this disclosure is ideally suited for magazines intended for use with an M&P™ 9 mm or 0.45 handgun firearm produced by Smith & Wesson®.

While the invention herein disclosed has been described by means of specific embodiments, examples and applications thereof, numerous modifications and variations could be made thereto by those skilled in the art without departing from the scope of the invention set forth in the claims.

What is claimed is:

1. An apparatus comprising:

a base pad retaining plate configured to engage a magazine base pad and a magazine spring, the base pad retaining plate comprising at least one protrusion for engagement with at least one circular through-hole in the magazine base pad, the at least one protrusion comprising:

a shaft portion;

a flange portion having a cross sectional diameter larger than a cross sectional diameter of the shaft portion; and a longitudinal slot along the longitudinal axis of the flange portion and at least a portion of the shaft portion, wherein when the at least one protrusion is engaged with the through-hole, the base pad retaining plate retains the magazine base pad through interference between the flange portion and an area of the magazine base pad surrounding the through-hole and between the shaft portion and the interior walls of the through-hole.

2. The apparatus of claim 1 wherein the shaft portion and the flange portion each comprise a circular cross section.

3. The apparatus of claim 1 wherein the at least one protrusion generally comprises a mushroom shape.

4. The apparatus of claim 1 further comprising a magazine base pad including a through-hole wherein the cross sectional diameter of the flange portion is larger than a diameter of the through-hole and wherein the cross sectional diameter of the shaft portion is less than the diameter of the through-hole.

5. The apparatus of claim 1 wherein the at least one protrusion is configured to compress laterally as the flange portion passes through the at least one through-hole in the magazine base pad and return to a substantially less compressed state when the flange portion has substantially passed through the at least one through-hole and the shaft portion resides substantially in the at least one through-hole.

6. The apparatus of claim 1 further comprising the magazine base pad configured for installation on an ammunition magazine housing and comprising:

the at least one through-hole;

a scalloped recess on the front edge of the magazine base pad; and a scalloped recess on each lateral side of the magazine base pad.

7. The apparatus of claim 6 wherein the magazine base pad further comprises:

a front edge existing at a distance of no more than about 0.440 inches from a front edge of the ammunition magazine housing when the magazine base pad is installed on the ammunition magazine housing.

8. The apparatus of claim 6 wherein the at least one through-hole of the magazine base pad further comprises a counter sink on the bottom surface of the magazine base pad surrounding the at least one through-hole and configured to receive the flange portion of the at least one protrusion.

9. A kit comprising:

a magazine base pad configured for installation on an ammunition magazine housing, the magazine base pad comprising at least one circular through-hole; and a base pad retaining plate configured to engage the magazine base pad and an ammunition magazine spring, the base pad retaining plate comprising at least one protrusion for engagement with the at least one through-hole in the magazine base pad, the at least one protrusion comprising:

a shaft portion;

a flange portion having a cross sectional diameter larger than a cross sectional diameter of the shaft portion; and a longitudinal slot along the longitudinal axis of the flange portion and at least a portion of the shaft portion wherein when the at least one protrusion is engaged with the through-hole, the base pad retaining plate retains the magazine base pad through interference between the flange portion and an area of the magazine base pad surrounding the through-hole and between the shaft portion and the interior walls of the through-hole.

10. The kit of claim 9 wherein the shaft portion and the flange portion each comprise a circular cross section and wherein the at least one protrusion generally comprises a mushroom shape.

11. The kit of claim 9 wherein the cross sectional diameter of the flange portion is larger than a diameter of the at least one through-hole and wherein the cross sectional diameter of the shaft portion is less than the diameter of the at least one through-hole, and wherein the at least one protrusion is configured to compress laterally as the flange portion passes through the at least one through-hole on the magazine base pad and return to a substantially less compressed state when the flange portion has substantially passed through the at least one through-hole and the shaft portion resides substantially in the at least one through-hole.

12. The kit of claim 9 wherein the magazine base pad further comprises:

a scalloped recess on the front edge of the magazine base pad;

a scalloped recess on each lateral side of the magazine base pad; and a front edge existing at a distance of no more than about 0.440 inches from a front edge of the ammunition magazine housing when the magazine base pad is installed on the ammunition magazine housing.

13. The kit of claim 9 wherein the magazine base pad further comprises:

tapering lateral sides, wherein an angle between the bottom surface of the magazine base pad and at least a majority of the surface of each lateral side is between 75 and 85 degrees; and dimples on the lower surface of the magazine base pad and configured to allow a user to identify a magazine.

14. The kit of claim 9 wherein the at least one through-hole of the magazine base pad further comprises a counter sink on the bottom surface of the magazine base pad surrounding the at least one through-hole and configured to receive the flange portion of the at least one protrusion.

15. A method of modifying an ammunition magazine for a firearm comprising:

installing a magazine base pad and a base pad retaining plate on an ammunition magazine housing;

wherein the magazine base pad is configured to engage the ammunition magazine housing and comprises at least one circular through-hole; and wherein the base pad retaining plate is configured to engage at least the magazine base pad and an ammunition magazine spring, the base pad retaining plate comprising at least one protrusion for engagement with the at least one through-hole in the magazine base pad, the at least one protrusion comprising:

a shaft portion;

a flange portion having a cross sectional diameter larger than a cross sectional diameter of the shaft portion; and a longitudinal slot along the longitudinal axis of the flange portion and at least a portion of the shaft portion, wherein when the at least one protrusion is engaged with the through-hole, the base pad retaining plate retains the magazine base pad through interference between the flange portion and an area of the magazine base pad surrounding the through-hole and between the shaft portion and the interior walls of the through-hole.

16. The method of claim 15 wherein the shaft portion and the flange portion each comprise a circular cross section and wherein the at least one protrusion generally comprises a mushroom shape and wherein the at least one through-hole of the magazine base pad further comprises a counter sink on the bottom surface of the magazine base pad surrounding the at least one through-hole and configured to receive the flange portion of the at least one protrusion.

17. The method of claim 15 wherein the cross sectional diameter of the flange portion is larger than a diameter of the at least one through-hole, and wherein the at least one protrusion is configured to compress laterally as the flange portion passes through the at least one through-hole on the magazine base pad and return to a substantially less compressed state when the flange portion has substantially passed through the at least one through-hole and the shaft portion resides substantially in the at least one through-hole.

18. The method of claim 17 wherein installing the magazine base pad and the base pad retaining plate on the ammunition magazine housing further comprises inserting the at least one protrusion through the at least one through-hole such that the flange portion substantially passes through the at least one through-hole to retain the magazine base pad to the base pad retaining plate.

* * * * *